US005559486A

United States Patent [19]

Ikenoue et al.

[11] Patent Number: 5,559,486

[45] Date of Patent: Sep. 24, 1996

[54] BOBBIN FOR HIGH FREQUENCY CORE

[75] Inventors: Tsuneo Ikenoue, 14-6 1-bancho 1-chome, Aoba-ku, Sendai-shi, Miyagi-ken; Hisahiro Kamata, Iwanuma, both of Japan

[73] Assignees: Tohoku Ricoh Co., Ltd.; Tsuneo Ikenoue, both of Miyagi-ken, Japan

[21] Appl. No.: 424,580

[22] Filed: Apr. 17, 1995

Related U.S. Application Data

[63] Continuation of Ser. No. 981,481, Nov. 25, 1992, abandoned.

[30] Foreign Application Priority Data

Nov. 28, 1991 [JP] Japan ..... 3-338002

[51] Int. Cl.[6] ..... H01F 27/02; H01F 27/30

[52] U.S. Cl. ..... 336/90; 336/82; 336/192; 336/198; 336/223

[58] Field of Search ..... 336/223, 82, 198, 336/208, 192, 90, 92

[56] References Cited

U.S. PATENT DOCUMENTS

| | | | |
|---|---|---|---|
| 3,070,766 | 12/1962 | Purdy | 336/198 |
| 3,185,948 | 5/1965 | Helberg | 336/198 |
| 3,781,741 | 12/1973 | Weiner | 336/198 |
| 3,843,946 | 10/1974 | Anderson et al. | 336/198 |
| 4,021,764 | 5/1977 | Winn | 336/223 |
| 4,234,865 | 11/1980 | Shigehana | 336/198 |
| 4,250,479 | 2/1981 | Bausch et al. | 336/208 |
| 4,507,640 | 3/1985 | Rich et al. | 336/223 |
| 4,510,478 | 4/1985 | Finkbeiner | 336/198 |
| 4,583,068 | 4/1986 | Dickens et al. | 336/82 |
| 4,714,909 | 12/1987 | Dugas | 336/198 |
| 4,725,805 | 2/1988 | Takada | 336/83 |
| 4,769,625 | 9/1988 | Meindl | 336/65 |
| 4,864,265 | 9/1989 | Peoples et al. | 336/5 |
| 4,988,968 | 1/1994 | Tochio et al. | 336/98 |

FOREIGN PATENT DOCUMENTS

| | | | |
|---|---|---|---|
| 1499015 | 11/1967 | France | 336/208 |
| 764271 | 5/1954 | Germany | 336/198 |
| 2651734 | 5/1978 | Germany | 336/198 |
| 305228 | 1/1933 | Italy | 336/208 |
| 393533 | 11/1965 | Switzerland | 336/198 |

*Primary Examiner*—Thomas J. Kozma

*Attorney, Agent, or Firm*—Evenson, McKeown Edwards and Lenahan, P.L.L.C.

[57] ABSTRACT

Disclosed a high-frequency core bobbin which comprises: a winding bobbin member on which a wingding is to be wound; a first bobbin member for accommodating therein a predetermined portion of the winding bobbin; a second bobbin member coupled with the first bobbin coaxially so as to cover a portion of the winding bobbin member exposed from the first bobbin member, or put on the first bobbin member in the axial direction so as to shut off a space portion of a portion opposite to the winding bobbin member; and a leading-out guide provided on the second bobbin member for insertion and leading-out of lead wires of the winding.

11 Claims, 12 Drawing Sheets

BOBBIN FOR HIGH FREQUENCY CORE

This application is a continuation of application Ser. No. 07/981,481, filed on Nov. 25, 1992, now abandoned.

BACKGROUND OF THE INVENTION

1. Field of the Invention

The present invention relates to a bobbin for making windings on a core for use in a switching power supply driven with a high frequency.

2. Description of the Related Art

A switching power supply is used as a power supply which is high in efficiency and which can be made small in size. In order to satisfy safety standards such as UL, CSA, IEC and so on, a predetermined insulation countermeasure is given to such a power supply. Specifically, other than use of a winding bobbin of an insulating material, an insulating material is inserted within such a bobbin.

FIG. 20 is a sectional view illustrating an example of a conventional high-frequency transformer.

A bobbin 2 is provided so as to be buried in a core 1, and a primary winding 3 is wound on the inner circumference of the bobbin 2 over a half of its depth from its bottom, with barrier tapes 4 interposed between the bobbin 2 and each f the opposite sides of the primary winding 3. After the primary winding 3 is wound by the required number of turns, an insulating tape 5 is provided over the surface of the primary winding 3. Then, a secondary winding 6 is wound on the insulating tape 5, with barrier tapes 7 interposed between the bobbin 2 and each of the opposite sides of the secondary winding 6, and an insulating tape 8 is further wound over the surface of the secondary winding 6. Here, each of the barrier tapes 4 and 7 is provided so as to have a thickness in a range of from 2 to 3 mm. Thus, by the provision of the barrier tapes 4 and 7, insulation distances between the primary and secondary windings and between the core and each of the primary and secondary windings are set so as to satisfy the safety standards. Then, the surface of the windings and leading-out wires are covered with insulating tubes (not-shown).

There is no problem in the case where the length L of the bobbin over which winding is provided is sufficiently long. If the length L is short, however, the performance of the transformer is lowered. For example, consideration will be made upon PQ 50.50 (for example, the size with which an output of about 1 KW can be extracted under the switching frequency of 100 KHz) which is the largest of the cores available in the market at present. Although the winding width of this bobbin is 32 mm, the width over which winding can be made becomes 26 mm when the width of each of the opposite side barrier insulating tapes is set to 3 mm (that is, the total width is set to 6 mm taking scattering into consideration, though it does not matter in the case where the width of each side barrier insulating tape is set to 2 mm, and hence the total width is set to 4 mm, in accordance with the UL standards). Accordingly, the total sectional area of the winding becomes about 4/5 of the bobbin space. In such a case, it is possible to obtain a winding having the same winding resistance and 4/5 inductance if the number of turns is set to 4/5 square root, and the sectional area of wire material to be used is set to 4/5 square root. Therefore, even if a safety standard countermeasure is performed by increasing the switching frequency to be 5/4-fold, it is possible to produce a transformer with almost the same copper loss and iron loss as those in the case of using the whole of the bobbin space.

However, it is usually difficult to provide such a performance as mentioned above in the case of an output in a range of from 50 to 300 watt often used in office automation equipment. For example, in the case of "EI30" with which it is possible to obtain an output of about 150 W at 100 KHz, the bobbin length is 13 mm and the width over which winding can be made is 7 mm if 3 mm-thick barrier insulating tapes are wound on the opposite sides of the winding, so that the axial length of a coil (hereinafter referred to as "coil length") becomes extremely short.

As a result, since the winding structure becomes short in its coil length and large in its winding thickness, not only can enough of a coil sectional area not be obtained but also the magnetic flux leakage of the transformer becomes large so that copper loss becomes large and spike voltage becomes high. Thus, the shape of the winding structure is not suitable for a switching power supply.

Further, in the case of "EI28" with which an output of about 150 W can be obtained by making the switching frequency high to 500 KHz, the bobbin length is about 9.6 mm, and the winding length becomes 3.6 mm if barrier insulating tapes are wound on the winding. Thus, it is almost impossible to realize a transformer.

In order to improve such a state even slightly, cores in which the length in the direction of the center pole axis is elongated without changing any other size have been increased recently. Although this improvement can make the sectional area of coil larger, it makes the effective magnetic flux sectional area smaller and makes the core loss larger at the same time, so that it cannot be a fundamental solution. At the present time, respective elements, ICs, and other parts have been improved in order to reduce the size of an apparatus, and also as for core material, cores corresponding to 200 KHz, 500 KHz, 1 MHz and so on have been realized.

In the above-mentioned conventional technique, however, there is a problem of design in the size and shape of a core because of limitations due to the safety standards, independently of the advance of core materials. This is a large obstacle in making a transformer small in size and high in frequency.

FIG. 21 is a conventional example of a pot core 17. In this conventional example, a winding is divided into a plurality of portions in the axial direction of a spool bobbin 18. That is, a primary winding 19 and a secondary winding 20 wound on the spool bobbin 18 side by side in the axial direction of the spool bobbin 18. The bobbin 18 having the primary and secondary windings 19 and 20 wound thereon is fixedly accommodated in the pot core 17. In this configuration, however, the degree of coupling is poor since the primary and secondary windings 19 and 20 are separated from each other to be upper and lower parts respectively, FIG. 22 is a conventional example of an EE-type core, in which a bobbin is constituted by a rectangular hollow primary winding bobbin 21 and a rectangular hollow secondary winding bobbin 22 coupled with the lower portion of the bobbin 21. A plurality of pins 23 are provided at predetermined intervals so as to project from the bottom of the secondary winding bobbin 22. A primary winding 24 is wound on the primary winding bobbin 21, and a secondary winding 25 is wound on the secondary winding bobbin 22. The center leg portion of an E-shaped core 26 is inserted into the hollow portion of the primary winding bobbin 21, and the center leg portion of the other E-shaped core (not-shown) is inserted into the hollow portion of the secondary winding bobbin 22 to thereby form a transformer. In such a bobbin structure, coupling is poor because of a gap produced between the primary and secondary windings. Further, windings are exposed so that it is difficult to ensure a sufficient creepage distance or a sufficient insulation distance and it is therefore difficult to cope with the safety standards in the case of a high-frequency core of the type in which the whole surface of the windings are covered with the core.

SUMMARY OF THE INVENTION

It is therefore an object of the present invention to solve the foregoing problems in the prior art and to provide a bobbin for use in a high-frequency core, which is superior in the degree of coupling between the primary and secondary windings and in the producibility while satisfying the safety standards.

In order to attain the above object, according to the present invention, the high-frequency core bobbin comprises: a winding bobbin member on which a winding is to be wound; a first bobbin member for accommodating therein a predetermined portion of the winding bobbin member; a second bobbin member coupled with the first bobbin member coaxially so as to cover a portion of the winding bobbin member exposed from the first bobbin member, or put on the first bobbin member in the axial direction so as to shut off a space portion of a portion opposite to the winding bobbin member; and a leading-out guide provided on the second bobbin member for insertion and leading-out of lead wires of the winding.

In order to obtain an insulation distance, preferably, an insulating tape is wound over the outer circumferential surface of the winding, or at least over the outer circumferential surface of the bobbin, when the bobbin is constituted by putting the second and first bobbin members on each other in the axial direction.

In order to reduce the leakage inductance, preferably, the leading-out guide is provided with a partition plate of an insulating material for separating the lead wires led out from the winding from each other in the inside of the leading-out guide.

In order to ensure an insulation distance of the lead wire leading-out portion, an extension guide including an insulating partition plate is provided in the vicinity of the leading-out guide.

In order to ensure a creepage distance between the lead wires in a connection portion when the extension guide is provided in a printed circuit board, the partition plate provided in the extension guide is made to project out of an opening of the printed circuit board.

In order to obtain an insulation distance between the primary and secondary windings and between the core and windings, preferably, a plurality of structures each constituted by the winding and the winding bobbin member are arranged coaxially.

According to the above-mentioned configuration, the bobbin is divided into a plurality of bobbin members which are coupled with each other radially or axially (longitudinally), and the winding is disposed so as to exist in the divisional bobbin members coupled with each other radially or axially or the bobbin walls of the divisional bobbin members are arranged coaxially. Therefore, the conditions of the creepage distances between the core and windings are satisfied, and the production of the structure becomes easy.

The insulating tape wound over the outer circumferential surface of the winding or at least over the outer circumferential surface of the bobbin ensures the insulation distance between the winding and the core or between the winding and other winding. Further, the partition plate functions to separate the leading-out wires from the winding from each other in the leading-out guide. Accordingly, it is possible to reduce the leakage inductance.

The extension guide provided with a partition plate performs wiring of the lead wires while ensuring the insulation between the lead wires led out of the bobbin. Accordingly, it is possible to ensure the insulation distance in the lead-wire leading-out portion.

If the partition plate provided in the extension guide is made to project from the opening of the printed circuit board, it is possible to ensure an enough insulation distance between the lead wires in a portion which is to be connected to the pattern of the printed circuit board.

If a plurality of structures constituted by the winding and the winding bobbin are provided coaxially, the bobbin walls are inserted between the wires, so that it is possible to provide enough insulation distances between the primary and secondary windings and between the core and windings.

DETAILED DESCRIPTION OF THE PREFERRED EMBODIMENTS

Embodiments of the present invention will be described with reference to the drawings.

Figure 1:
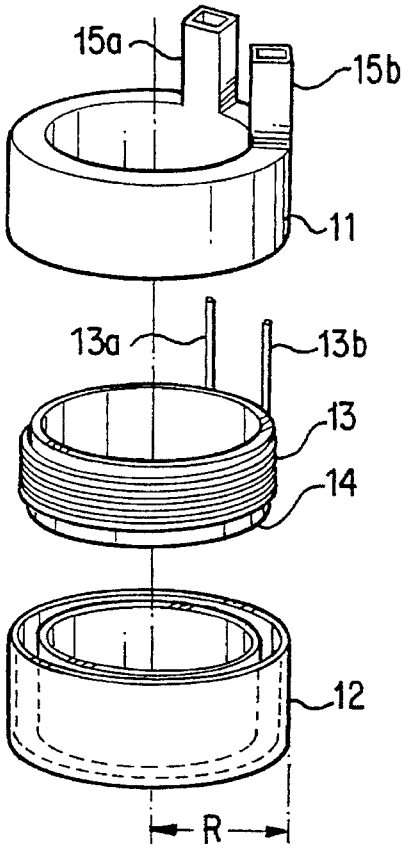
FIG. 1 is an exploded perspective view illustrating a first embodiment of the bobbin for use in a high-frequency core according to the present invention.
Figure 2:
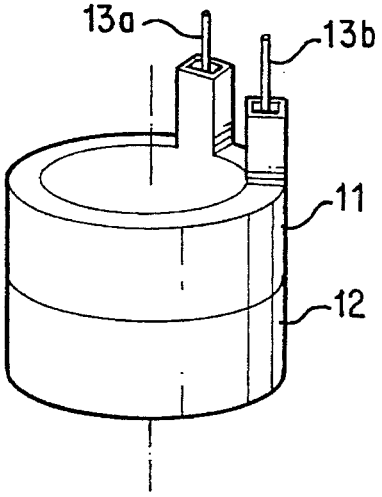
FIG. 2 is a perspective view illustrating the high-frequency core bobbin of the first embodiment of FIG. 1 after assembly.

FIG. 1 is an exploded perspective view illustrating an embodiment of the high-frequency core bobbin according to the present invention, and FIG. 2 is a perspective view illustrating the bobbin of FIG. 1 after assembly.

In this embodiment, a bobbin is constituted by an upper bobbin 11, which is a second bobbin, and a lower bobbin 12 which is a first bobbin. Each of the upper and lower bobbins 11 and 12 is made of a plastic material or the like so as to have a circular groove defined by inner and outer walls. A winding bobbin 14 provided with a winding 13 is inserted into the upper and lower bobbins 11 and 12. Lead wire leading-out guides 15*a* and 15*b* are provided on the upper edge of the upper bobbin 11 for leading out lead wires 13*a* and 13*b* on the both ends of the winding 13 while maintaining those lead wires in the electrically insulated state.

In assembling, first, the winding bobbin 14 having the winding 13 wound in advance is accommodated in the lower bobbin 12. Then, the lead wires 13*a* and 13*b* are inserted through the lead wire leading-out guides 15*a* and 15*b*, and the upper bobbin 11 is put on the lower bobbin 12 as shown in FIG. 2, thereby completing a coil structure.

Figure 3:
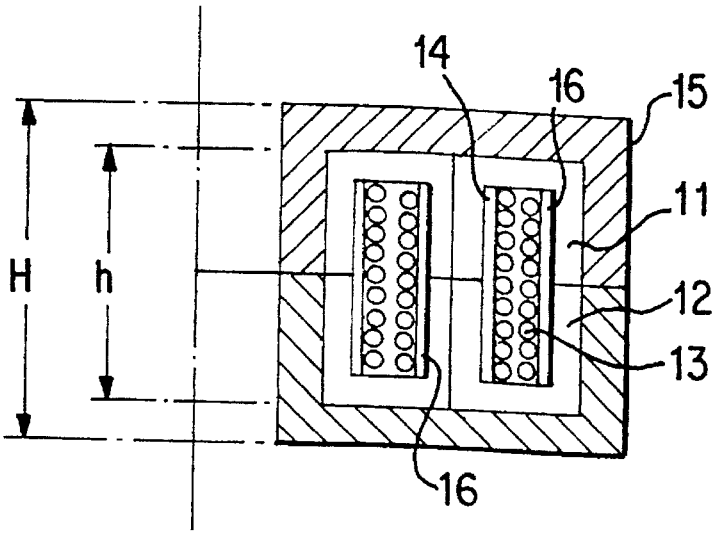
FIG. 3 is a sectional view illustrating a transformer using the first embodiment of the present invention.
Figure 4:
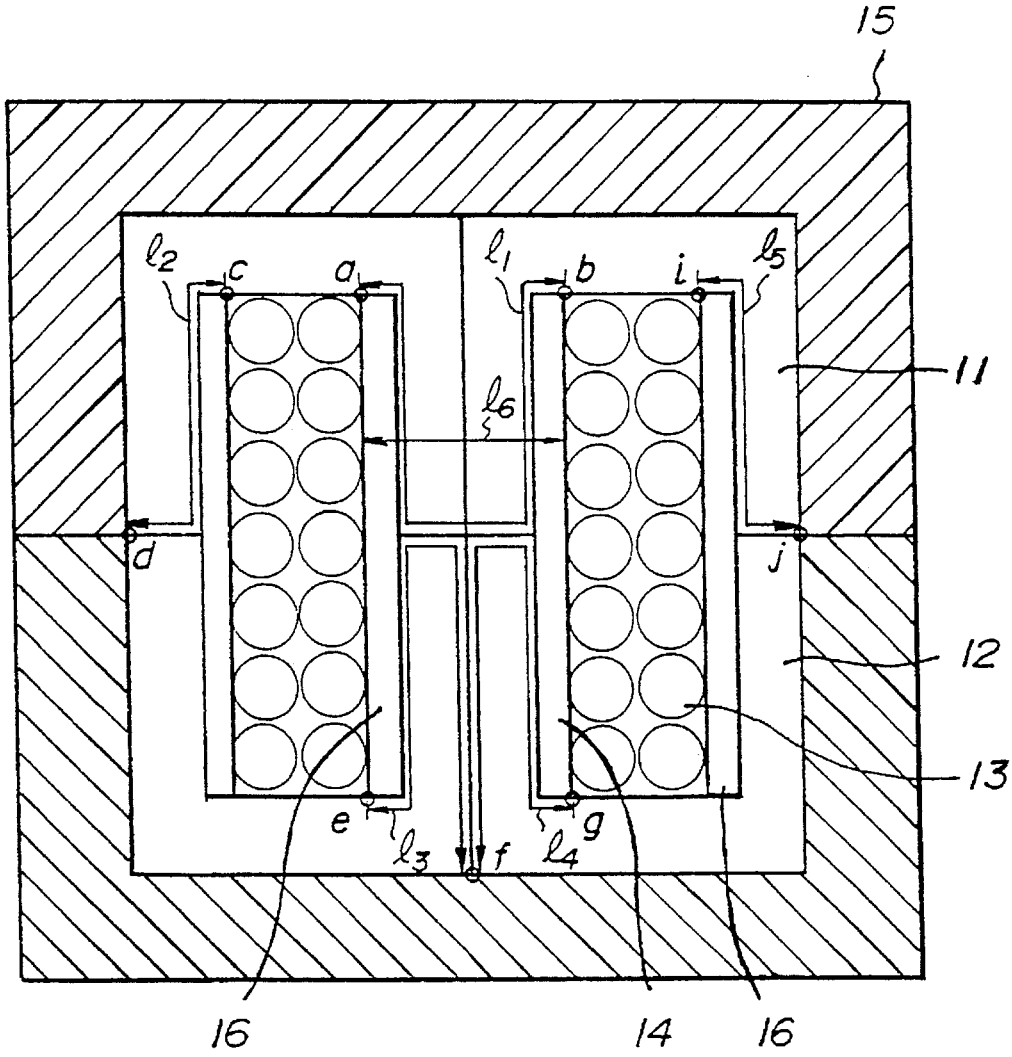
FIG. 4 is an explanatory diagram specifically illustrating creepage distances in the transformer of FIG. 3.

FIG. 3 is a sectional view illustrating a transformer using the above embodiment (only the right portion from the center being shown), and FIG. 4 is an explanatory view specifically illustrating creepage distances of the transformer illustrated in FIG. 3. In this case, two coils each of which is similar to that shown in FIG. 2 are made while changing the respective diameters of the bobbins. The thus prepared two coils are disposed coaxially in a halved high-frequency core 15 so as to act as secondary and primary coils respectively. At this time, an insulating tape 16 is wound over the outside of each of the windings. The positions of the secondary and primary coils may be reversed to each other.

Although the thickness of each of the upper and lower bobbins 11 and 12 covering the windings is selected to be not less than 0.71 mm so as to satisfy the standards such as the UL standard and so on, it may be made thinner than the above-mentioned value if the material of the bobbins satisfies the evaluation test of the bobbins. Further, the thickness of the winding bobbin 14 may be selected to be a suitable value so long as the value satisfies enough strength.

In such a configuration, consideration will be made on a high-frequency core which has a shape being 35 mm ϕ in diameter and 12 mm in core height H and which is equivalent in weight to "EER28". The height h of the inside groove of the core in FIG. 3 is 8 mm. Then, let the thickness of each of the upper and lower bobbins be 0.71 mm, the thickness of the winding bobbin 14 be 0.5 mm, and the thickness of the insulating tape 16 be 0.1 mm, and the following values can be obtained.

(1) Creepage distance $l_1$ between primary and secondary windings:

$$l_1 = (h - 0.71 \times 2) + 0.71 \times 2 + 0.5 + 0.1$$
$$= 8.1 \text{ [mm]} \quad \ldots \text{(between the points } \underline{a} \text{ and } \underline{b})$$

(2) Creepage distances $l_2$, $l_3$, $l_4$, $l_5$ between windings and core:

- Creepage distance between primary winding and core:

on the inner side, $$l_2 = (h/2 - 0.71) + 0.71 + 0.5$$
$$= 4.5 \text{ [mm]} \quad \ldots \text{(between the points } \underline{c} \text{ and } \underline{d})$$

on the outer side, $$l_3 = (h/2 - 0.71) + 0.71 + 0.1 + h/2$$
$$= 8.1 \text{ [mm]} \quad \ldots \text{(between the points } \underline{e} \text{ and } \underline{f})$$

- Creepage distance between secondary winding and core:

on the inner side, $$l_4 = (h/2 - 0.71) + 0.71 + 0.5 + h/2$$
$$= 8.5 \text{ [mm]} \quad \ldots \text{(between the points } \underline{g} \text{ and } \underline{h})$$

on the outer side, $$l_5 = (h/2 - 0.71) + 0.71 + 0.1$$
$$= 4.1 \text{ [mm]} \quad \ldots \text{(between the points } \underline{i} \text{ and } \underline{j})$$

At this time, the distance $l_6$ between the primary and secondary windings is:

$$l_6 = 0.71 \times 2 + 0.5 + 0.1 \times 2$$
$$= 2.12 \text{ [mm]}$$

Figure 21:
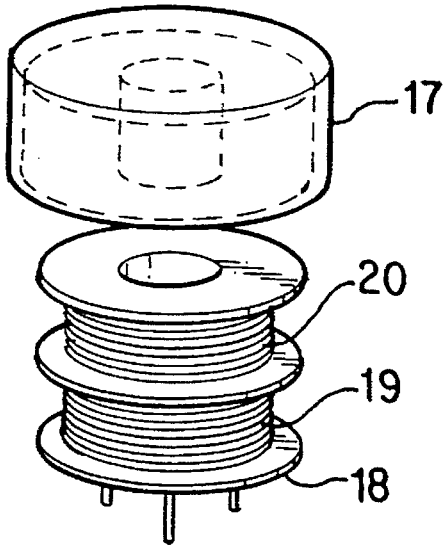
FIG. 21 PRIOR ART
FIG. 21 is a sectional view illustrating a conventional pot core.
Figure 22:
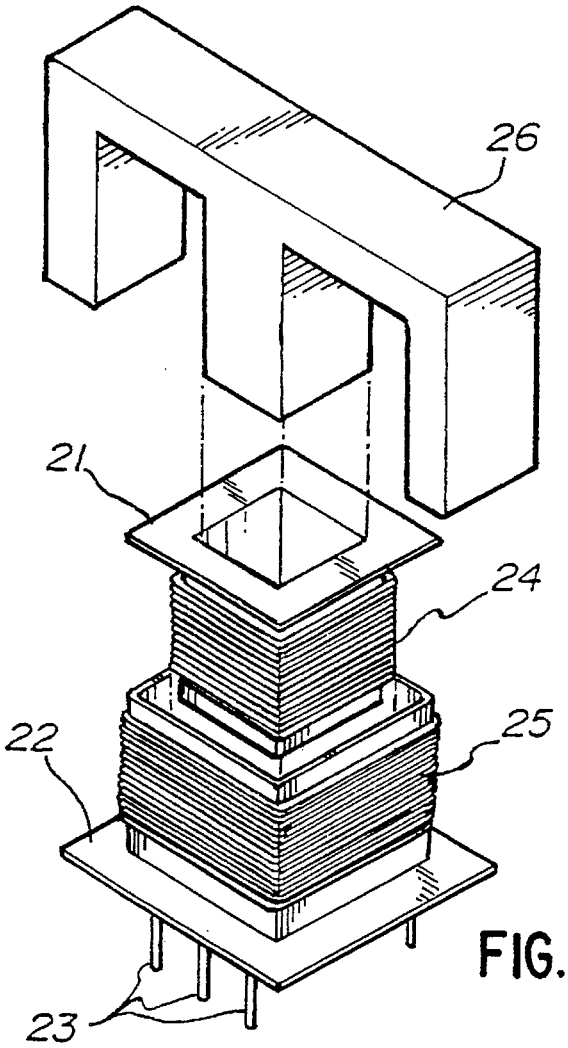
FIG. 22 PRIOR ART
FIG. 22 is a view illustrating a transformer constituted by a divided bobbin of a conventional EI-type core.

Consequently, it is possible to obtain the creepage distances which can satisfy the safety standards, and it is possible to obtain the degree of coupling between the primary and secondary windings which is superior to that of such a conventional bobbin as shown in FIGS. 21 and 22.

Figure 5:
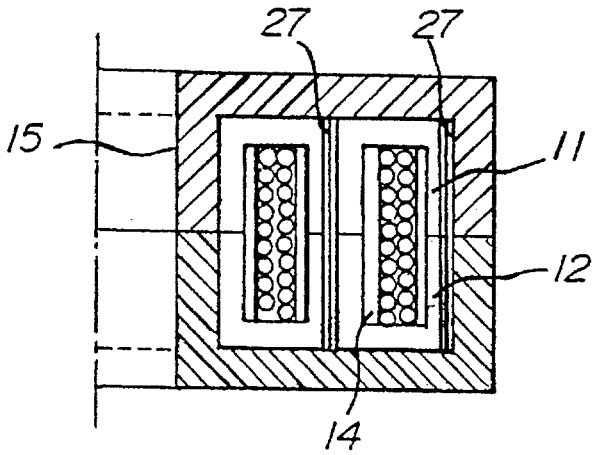
FIG. 5 is a sectional view illustrating a modification of the first embodiment of FIG. 3.

FIG. 5 is a sectional view illustrating a modification of the embodiment in FIG. 3. An insulating tape 27 is wound over the outer surface of each bobbin in this modification, while the insulating tape 16 is wound over the winding 13 in FIG. 3. According to the configuration of this modification, it is possible to satisfy the safety standards and to form a transformer improved in the degree of coupling similarly to the embodiment shown in FIG. 3.

Although the case of a core having a shape in which the diameter is 35 mm ϕ, H=12 mm, and h=8 mm, has been described in the above description, similar transformers can be constituted by other sized high-frequency cores by adjusting the thickness of the bobbins, the width of the insulating tapes, and so on.

Further, in the safety standards such as IEC950 or the like, there is a case where creepage distances between windings and cores not less than 8 mm are required in order to cope with SELV. In this case, such creepage distances can be attained by winding an insulating tape partially on or over the whole of the outer circumference of the bobbin in FIGS. 3 and 5.

Figure 6:
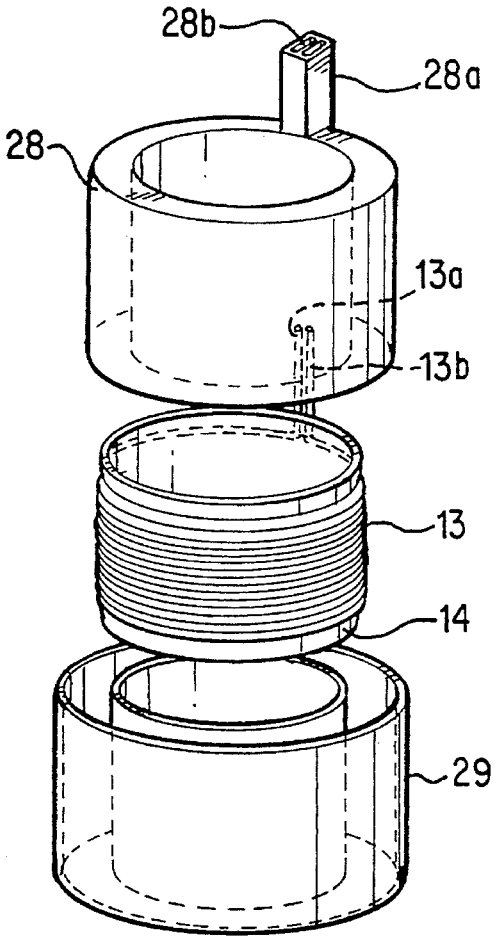
FIG. 6 is an exploded perspective view illustrating a second embodiment of the high-frequency core bobbin according to the present invention.
Figure 7:
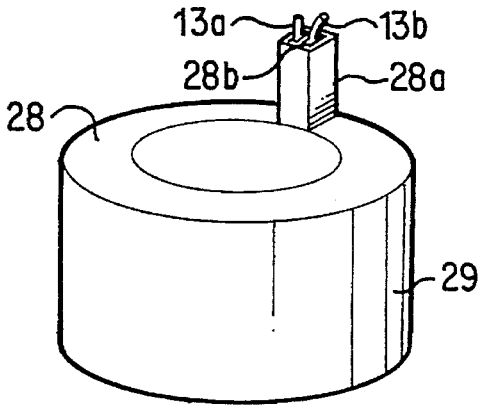
FIG. 7 is a perspective view illustrating the high-frequency core bobbin of the second embodiment of FIG. 6 after assembly.

FIG. 6 is an exploded perspective view illustrating a second embodiment of the high-frequency core bobbin according to the present invention, and FIG. 7 is a perspective view illustrating the embodiment of FIG. 6 after assembled. In FIG. 6, parts the same as those in the above-mentioned embodiment are referenced correspondingly, and the description about the parts will be omitted.

While the above-mentioned embodiment has a configuration in which the upper and lower bobbins 11 and 12 are vertically put on and combined with each other, this embodiment has such a configuration in which an inner bobbin 28 which is a second bobbin has a height equal to the sum of the respective heights of the upper and lower bobbins 11 and 12 of FIG. 1 and is capable of accommodating therein a winding bobbin 14 having a winding 13 wound thereon, and an outer bobbin 29 which is a first bobbin has inner and outer walls so that the inner bobbin 28 can be inserted into a space between the inner and outer walls. In assembling, the winding bobbin 14 and the inner bobbin 28 are inserted in the outer bobbin 29 in such a manner as shown in FIG. 7 to thereby complete a coil structure. Although two lead wire leading-out guides 15*a* and 15*b* are provided for leading out the respective lead wires in the above embodiment of FIG. 3, only one lead wire leading-out guide 28*a* is provided on the inner bobbin 28 in this embodiment. More specifically, a partition plate 28*b* of an insulating material is provided in the inside of the lead wire leading-out guide 28*a* so as to divide the inside into two portions so that the lead wires 13*a* and 13*b* can be led out through the two separated inside portions of the lead wire leading-out guide 28*a*.

Figure 8:
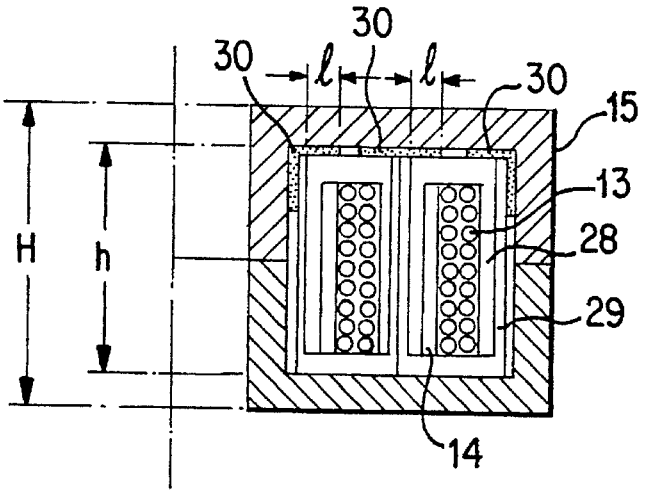
FIG. 8 is a sectional view illustrating a transformer using the embodiment of FIG. 6.
Figure 9:
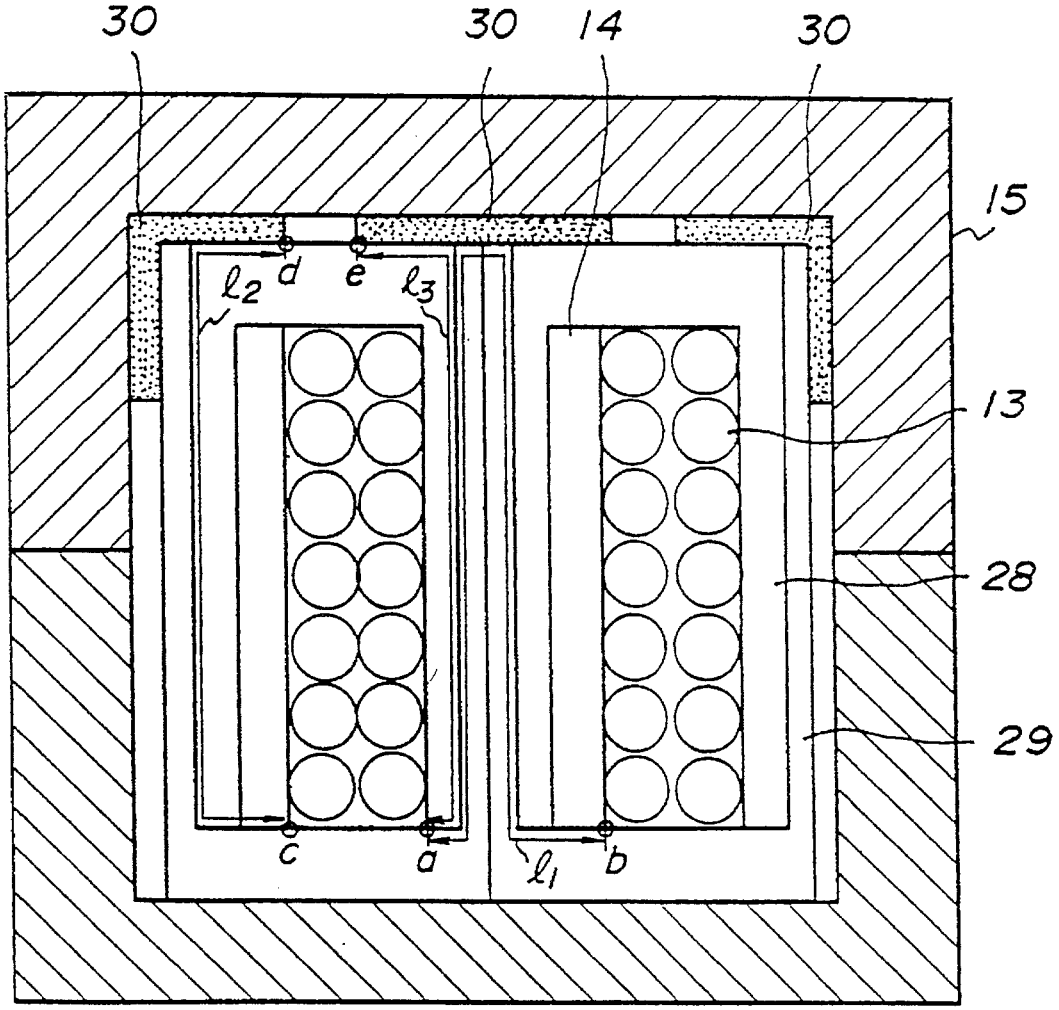
FIG. 9 is an explanatory diagram specifically illustrating creepage distances in the transformer of FIG. 8.

FIG. 8 is a sectional view illustrating a transformer using the above embodiment (only the right portion from the center being shown) of FIG. 6, and FIG. 9 is an explanatory view specifically illustrating creepage distances of the transformer illustrated in FIG. 8. In this case, similarly to the case of FIG. 3, two coils each of which is similar to that shown in FIG. 6 are made while changing the respective diameters of the bobbins. The thus prepared two coils are disposed coaxially in a halved high-frequency core 15 so as to act as secondary and primary coils respectively. Then, an insulating tape 30 is wound over a coupling portion of the inner and outer bobbins 28 and 29. The positions of the secondary and primary coils may be reversed to each other.

In such a configuration, similarly to the case of FIG. 3, consideration will be made on a high-frequency core which has a shape being 35 mm ϕ in diameter and 12 mm in core height H. The creepage distances can be obtained as follows.

In the case where

- thickness of couplimg surface of the inner and outer bobbins 28 and 29: 0.71/2 = 0.355 mm
- thickness of the winding bobbin 14: 0.5 mm
- thickness of the insulating tape 30: 0.1 mm (1) Creepage distance $l_1$ between primary and secondary windings:

$$l_1 = 0.355 \times 4 + 0.5 + (8 - 0.71 - 0.1) \times 2$$

$$= 16.3 >> 8 \text{ [mm]} \quad \ldots \text{(between the points } \underline{a} \text{ and } \underline{b})$$

(2) Creepage distances $l_2$, $l_3$ between windings and core (tape length $l$ from the coupling surface being $l = 0.5$ mm)

- Creepage distance $l_2$ between the inner winding portion (with respect to the primary winding) and the core $$l_2 = 0.5 + (8 - 0.71 - 0.1) + 0.5$$

$$= 8.19 > 8 \text{ [mm]} \quad \ldots \text{(between the points } \underline{c} \text{ and } \underline{d})$$

- Creepage distance $l_3$ between the outer winding portion and the core $$l_3 = 0.355 + (8 - 0.71 - 0.1) + 0.5$$

$$= 8.045 > 8 \text{ [mm]} \quad \ldots \text{(between the points } \underline{a} \text{ and } \underline{e})$$

Consequently it is possible to satisfy the creepage distance of 8 mm between the windings and the core. The same result can be obtained on the secondary winding.

Although a single wire is illustrated for the windings in the embodiment in FIGS. 6 and 7, a foil winding or a band conductor (for example, a sheet-like parallel multi-line wire produced by Furukawa Electric Co. Ltd.) may be used. In this case, it is possible to reduce the leakage inductance between the primary and second windings and in the leading-out portion.

Figure 10:
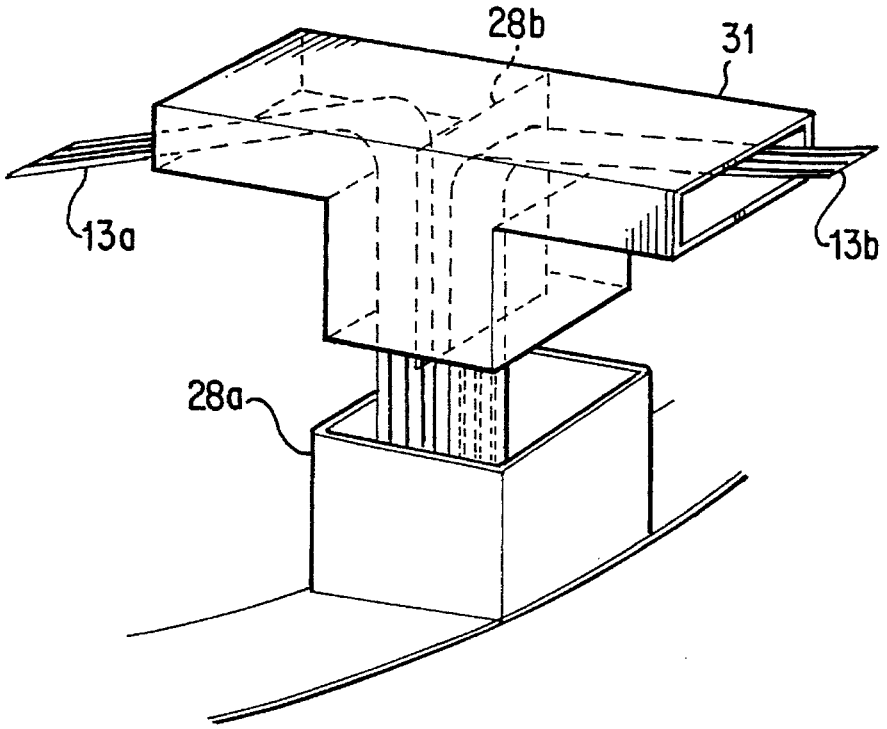
FIG. 10 is a perspective diagram illustrating an extension guide according to the present invention.

FIG. 10 shows a lead wire leading-out portion in FIG. 7, in which an extension guide 31 including a partition plate 28*b* of "T"-shaped insulating material is provided on the upper portion of the lead wire leading-out guide 28*a*, so that band wires 13*a* and 13*b* led out through the lead wire leading-out guide 28*a* are made to pass through the paths of the guide 31. Consequently, it is possible to ensure an enough creepage distance after leading out the lead wires.

Figure 11:
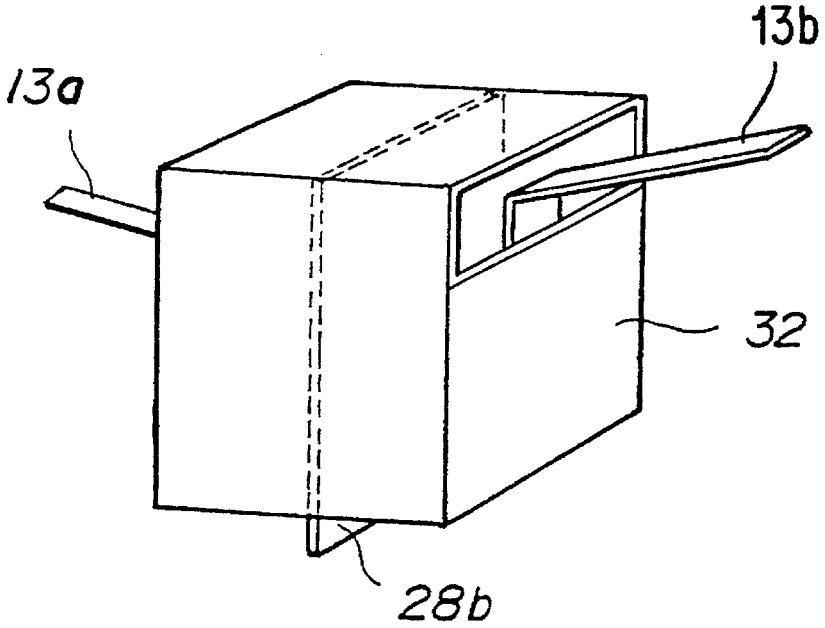
FIG. 11 is a perspective view illustrating a second example of the extension guide of FIG. 10.
Figure 12:
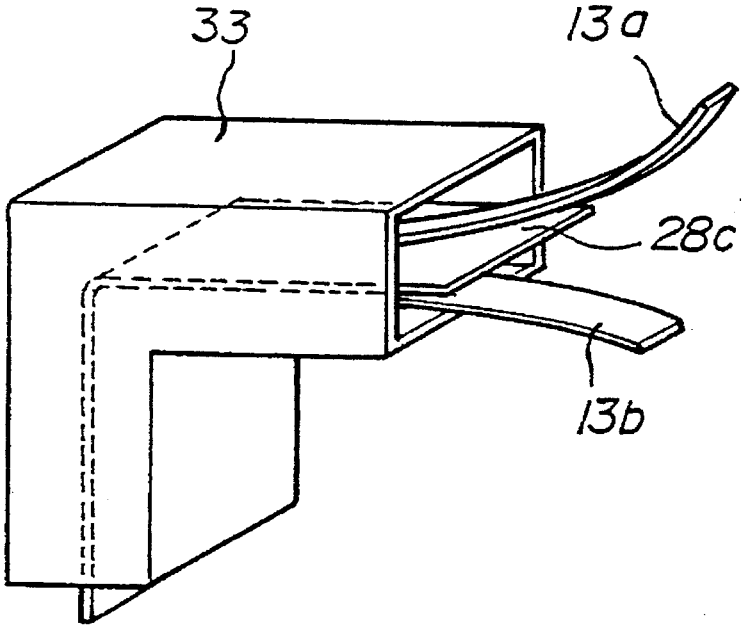
FIG. 12 is a perspective view illustrating a third example of the extension guide.

The shape of the extension guide 31 may be modified to have a configuration as shown in FIGS. 11 or 12, other than the "T" shape of FIG. 10. In FIG. 11, an extension guide 32 is formed into a shape having two portions like mail boxes on the opposite sides of a partition plate 28*b*, so that the lead wires 13*a* and 13*b* can be led out through the openings of the respective box-like portions. On the other hand, in FIG. 12, an "L"-shaped extension guide 33 is provided with a partition plate 28*c* for dividing its inside space into two portions so that the lead wires 13*a* and 13*b* can be inserted and passed through the two space portions.

Figure 13:
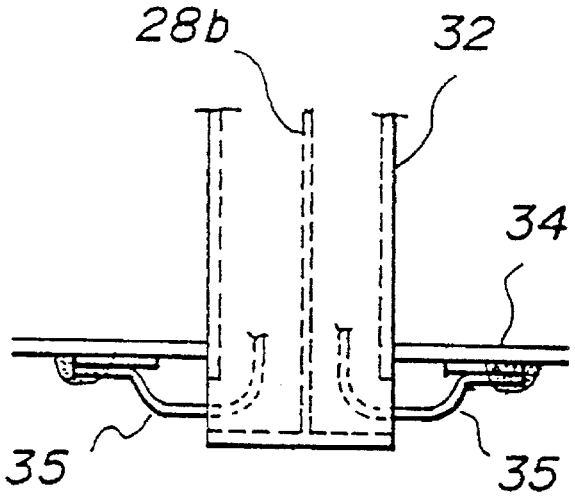
FIG. 13 is a front view illustrating an example of the fixation of the extension guide of FIG. 11.
Figure 14:
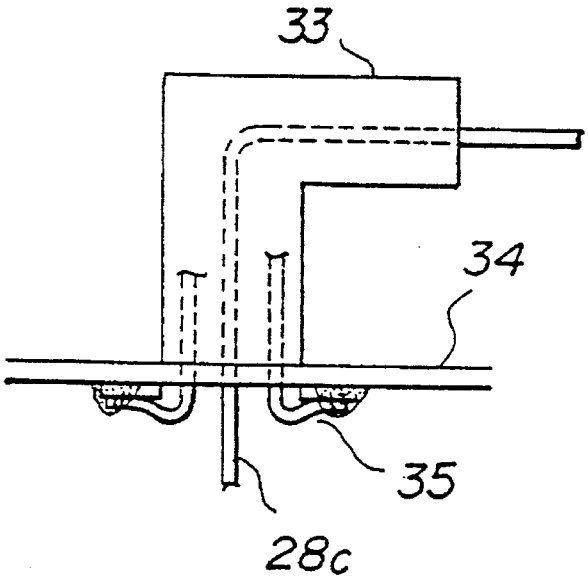
FIG. 14 is a front view illustrating an example of the fixation of the extension guide in FIG. 12.

FIGS. 13 and 14 are front views in the cases of printed wirings according to the extension guides 32 and 33 shown in FIGS. 11 and 12. In FIG. 13, a printed-circuit board 34 is used. A pattern for soldering joints (to which the lead wires 13*a* and 13*b* of the windings 13 are to be connected) is formed in this printed circuit board 34, and an opening for inserting a base portion of the extension guide 32 is further provided in the printed circuit board 34. The respective one ends of lead wires 35 are connected to the pattern of the printed circuit board 34. On the other hand, in FIG. 14, a base portion of the L-shaped extension guide 33 is fixed on the printed circuit board 34, the lead wires 35 and the partition plate 28*c* are penetrated through the printed circuit board 34, and the respective end portions of the lead wires 35 exposed in the lower surface of the printed circuit board surface 34 are connected to the pattern.

Figure 15:
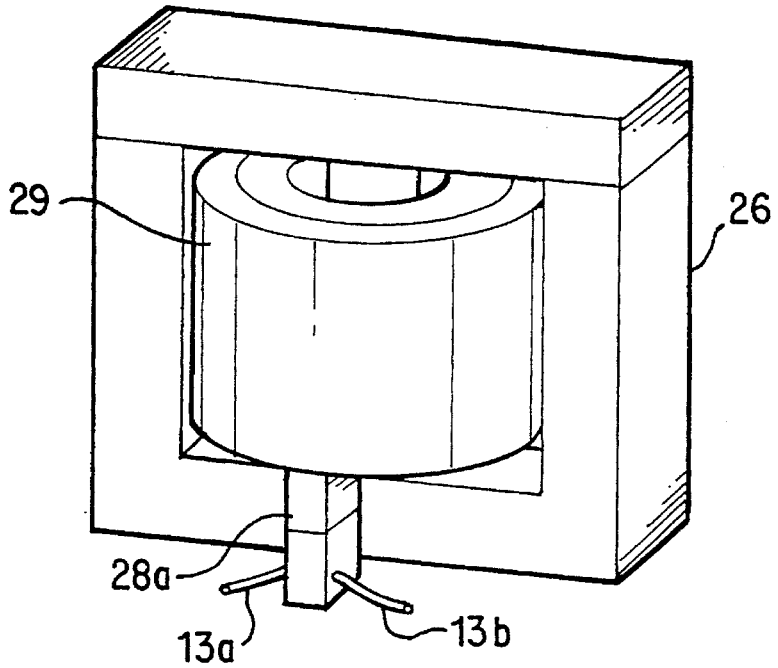
FIG. 15 is a perspective view illustrating a transformer constituted by use of an EI-type core to which the embodiment of FIG. 6 is applied.
Figure 16:
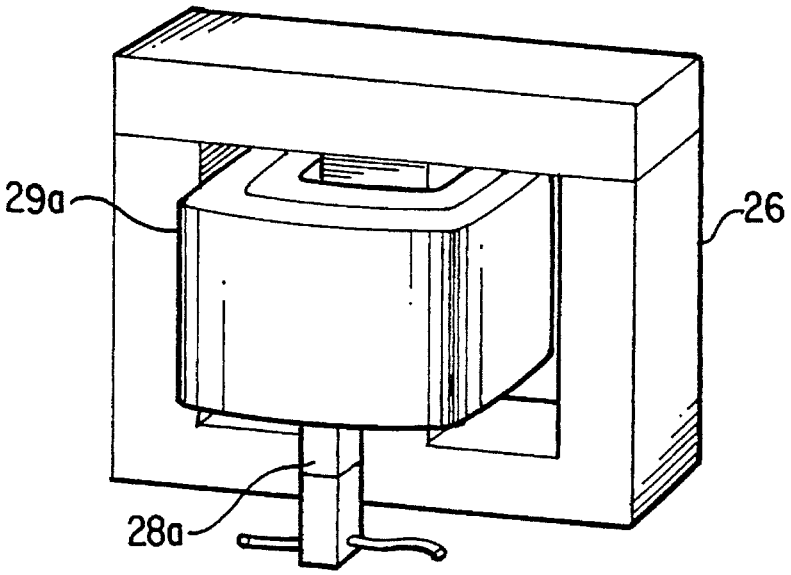
FIG. 16 is a perspective view illustrating a transformer in which inner and outer bobbins are made rectangular.

FIG. 15 shows a configuration of a transformer in which the embodiment of FIG. 6 is applied to an EI-type core 26, the coil structure being inserted into an "I" leg portion of the core. Further, the transformer of FIG. 16 has a feature in that the respective shapes of the coil portion 29*a* and the inner and outer bobbins 28 and 29 are made rectangular while they are made round in the embodiment of FIG. 6.

Figure 17:
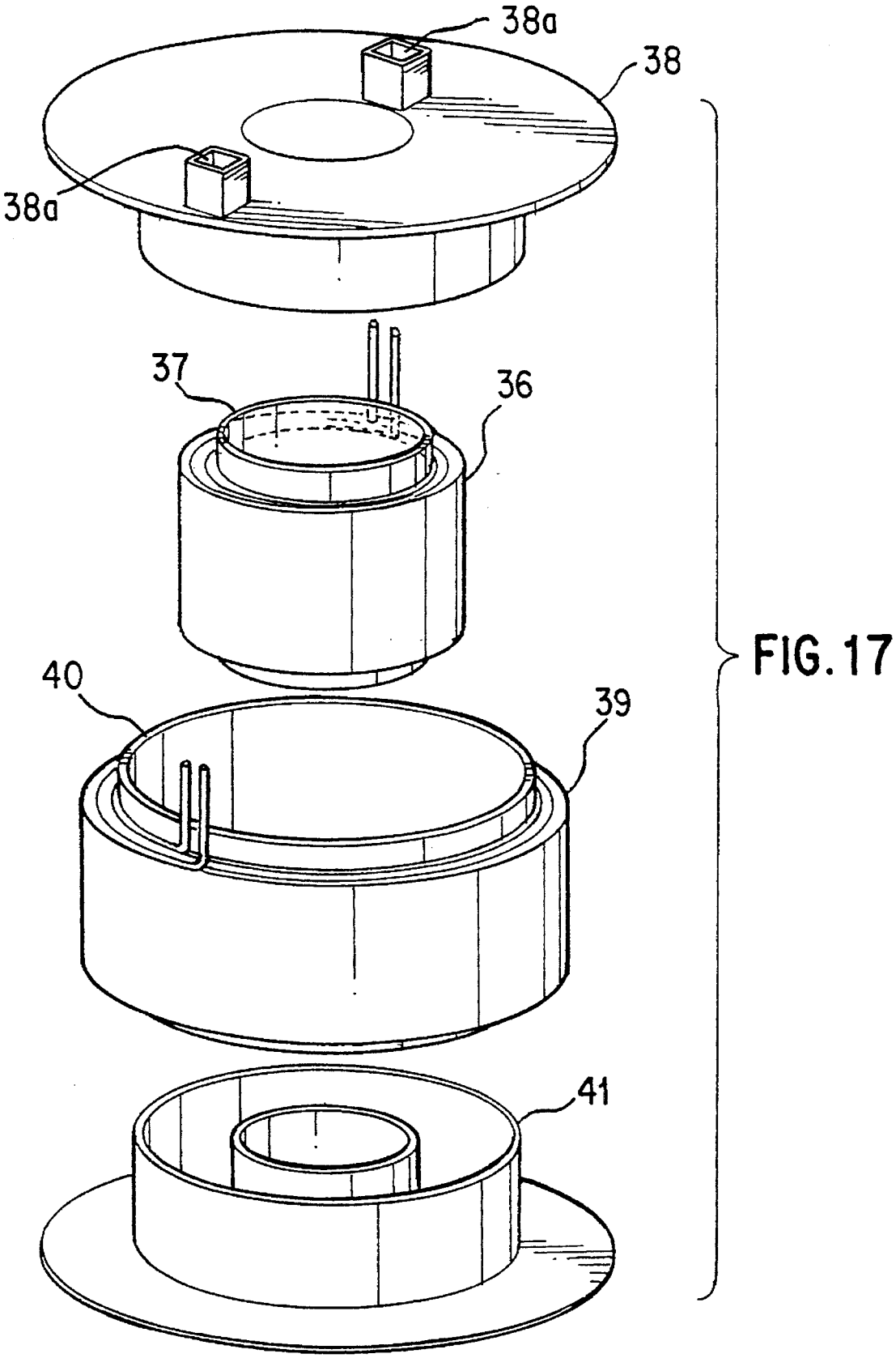
FIG. 17 is an exploded perspective view illustrating a third embodiment of the high-frequency core bobbin according to the present invention.
Figure 18:
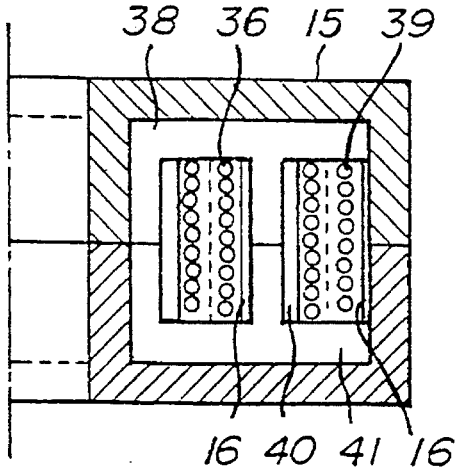
FIG. 18 is a sectional view illustrating a main portion of the embodiment of FIG. 17.

FIG. 17 is an exploded perspective view illustrating a third embodiment of the high-frequency core bobbin according to the present invention, and FIG. 18 is a sectional view illustrating a main portion of the embodiment of FIG. 17.

Although one bobbin forms one coil portion in the above embodiments, this embodiment has a configuration constituted by: an upper bobbin 38 into which a winding bobbin 37 having a primary winding 36 wound thereon can be inserted and which has lead wire leading-out guides 38*a* (two guides for primary and secondary windings 36 and 39 are provided at positions opposite to each other); and a lower bobbin 41 into which a winding bobbin 40 having the secondary winding 39 wound thereon can be inserted and into which the upper bobbin 38 having the primary winding 36 mounted thereon can be inserted.

In this embodiment, after the secondary winding 39 is mounted on the lower bobbin 41, the primary winding 36 is mounted in a groove of the lower bobbin 41. Next the position of the upper bobbin 38 is adjusted so as to make the respective lead wires of the windings come to the positions of the lead wire leading-out guides 38*a*, and the upper bobbin 38 as it is is put on the lower bobbin 41 to thereby obtain such an arrangement as shown in FIG. 18. In this case, an insulating tape 16 is wound on the outer surface of the respective windings in the same manner as in the embodiment of FIG. 3.

In the transformer of FIG. 18, since it is possible to reduce the distance between the primary and secondary windings by the thickness of a bobbin, it is possible to obtain a transformer further superior in the degree of coupling. Further, in the case where the primary winding is arranged on the inner side, the distance between the winding end portion and the core is so long that an insulating tape in a joint portion as shown in FIG. 8 is not necessary, so that it is possible to simplify the process of assembling. Further, it is possible to wind the secondary winding 39 directly, without using a winding bobbin, after winding the primary winding 36, so that the distance between the primary and secondary windings can be reduced by the thickness of the bobbin. It is therefore possible to obtain a transformer further superior in the degree of coupling.

Although a single secondary winding is used in FIG. 18, a plurality of secondary windings (or a plurality of primary windings) can be used if the number of grooves are increased in the radial direction.

Figure 19:
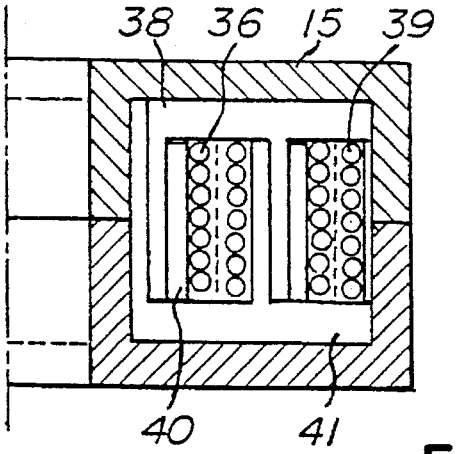
FIG. 19 is a sectional view illustrating a modification of the transformer of FIG. 18.
Figure 20:
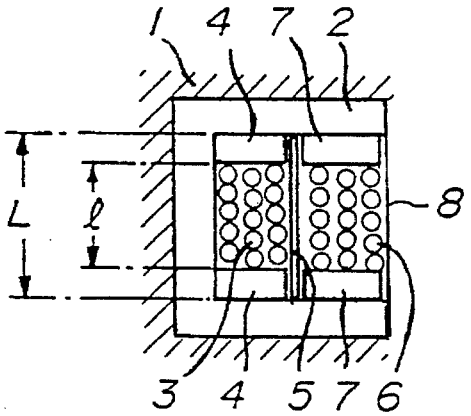
FIG. 20 PRIOR ART
FIG. 20 is a sectional view illustrating an example of a conventional high-frequency transformer.

FIG. 19 is a sectional view of a modification of the transformer of FIG. 18. As is apparent from FIG. 19, the transformer of FIG. 19 has a feature in that the positions of groove edges of upper and lower bobbins 38 and 41 are shifted in the radial direction. Consequently, it is possible to obtain an effect similar to that of the transformer of FIGS. 7 and 8.

What is claimed is:

1. A bobbin arrangement for a high-frequency core having a center hole and having a first bobbin set and a second bobbin set, said first bobbin set enclosing a first winding, said second bobbin set enclosing a second winding, said first bobbin set arranged coaxially and concentrically with respect to said second bobbin set, each of set first and said second bobbin sets comprising:

a winding bobbin member on which the respective winding is wound;

a first bobbin housing member accommodating therein a predetermined portion of said winding bobbin member and respective winding;

a second bobbin housing member coupled with said first bobbin housing member coaxially so as to cover a portion of said winding bobbin member exposed from said first bobbin housing member, said first and second bobbin housing members substantially completely enclosing their respective windings; and a leading-out guide provided on said second bobbin housing member for insertion and leading-out of lead wires of said respective winding wound on said winding bobbin member.

2. A bobbin arrangement for a high-frequency core having a center hole and having a first bobbin set and a second bobbin set, said first bobbin set enclosing a first winding, said second bobbin set enclosing a second winding, said first bobbin set arranged coaxially and concentrically with respect to said second bobbin set, each of said first and said second bobbin sets comprising:

a winding bobbin member on which the respective winding is wound;

a first bobbin housing member accommodating therein a predetermined portion of said winding bobbin member and respective winding;

a second bobbin housing member placed on said first bobbin housing member in the axial direction so as to shut off a space portion of a portion opposite to said winding bobbin member, said first and second bobbin housing members substantially completely enclosing their respective windings; and a leading-out guide provided on said second bobbin housing member for insertion and leading-out of lead wires of said respective winding wound on said winding bobbin member.

3. A bobbin arrangement for a high-frequency core according to claim 1 or 2, wherein an insulating tape is wound on the outer circumferential surface of at least one of said first and said second bobbin sets.

4. A bobbin arrangement for a high-frequency core according to claim 1 or 2, wherein said leading-out guide is provided with a partition plate of an insulating material for separating said lead wires led out from said winding from each other in the inside of said leading-out guide.

5. A bobbin arrangement for a high-frequency core according to claim 1 or 2, wherein an extension guide including an insulating partition plate is provided in the vicinity of said leading-out guide.

6. A bobbin arrangement for a high-frequency core according to claim 5, wherein said partition plate provided in said extension guide is configured to project out of an opening of a printed circuit board.

7. A bobbin arrangement for a high-frequency core according to claim 1 or 2, having a plurality of said first and said second bobbin sets.

8. A bobbin arrangement for a high-frequency core according to claim 1 or 2, wherein an insulating tape is wound on the outer circumferential surface of at least one of said first and said second windings.

9. A bobbin arrangement for a high-frequency core according to claim 1 or 2, wherein the first winding and the second winding are one of foil conductors and band conductors.

10. A bobbin arrangement for a high-frequency core according to claim 1 or 2, wherein said first and said second bobbin sets and said first and said second windings have a round cross-section when viewed in the axial direction.

11. A bobbin arrangement for a high-frequency core according to claim 1 or 2, wherein said first and said second bobbin sets and said first and said second windings have a rectangular cross-section when viewed in the axial direction.

* * * * *